US009382698B2

(12) United States Patent
Yang

(10) Patent No.: US 9,382,698 B2
(45) Date of Patent: Jul. 5, 2016

(54) TAP AND AN ADAPTER THEREOF

(71) Applicant: OU PI SHENG CO., LTD., Taichung (TW)

(72) Inventor: Chin Chung Yang, Taichung (TW)

(73) Assignee: Ou Pi Sheng Co., Ltd., Taichung (TW)

( * ) Notice: Subject to any disclaimer, the term of this patent is extended or adjusted under 35 U.S.C. 154(b) by 0 days.

(21) Appl. No.: 14/446,604

(22) Filed: Jul. 30, 2014

(65) Prior Publication Data

US 2016/0032569 A1 Feb. 4, 2016

(51) Int. Cl.
*E03C 1/02* (2006.01)

(52) U.S. Cl.
CPC ..... *E03C 1/021* (2013.01)

(58) Field of Classification Search
CPC ..... F16L 15/08; E03C 1/021; E03C 1/02; E03C 1/025; E03C 1/0403; E03C 1/0404; E03C 1/042
USPC ..... 285/404; 137/360, 801; 4/678
See application file for complete search history.

(56) References Cited

U.S. PATENT DOCUMENTS 2,374,138 A * 4/1945 Sanford ..... F16L 15/08 285/110
2,997,058 A * 8/1961 Hall ..... E03C 1/023 137/360
3,136,570 A * 6/1964 Lee ..... E03C 1/042 137/360
3,371,679 A * 3/1968 Minella ..... E03C 1/042 137/360
3,602,244 A * 8/1971 Ward ..... E03C 1/104 4/678
3,640,305 A * 2/1972 Young ..... E03C 1/042 4/678
3,739,806 A * 6/1973 Bucknell ..... E03C 1/0404 4/678
3,913,605 A * 10/1975 Ward ..... E03C 1/042 137/467
4,171,005 A * 10/1979 Nicklas ..... F16K 19/00 137/467
5,165,121 A * 11/1992 McTargett ..... E03C 1/0404 4/678
6,154,608 A * 11/2000 Rochelle ..... H05B 3/42 392/487
6,175,972 B1 * 1/2001 Wales ..... E03C 1/042 4/678
6,192,529 B1 * 2/2001 Jones ..... E03C 1/042 4/678
6,267,145 B1 * 7/2001 Sun ..... E03C 1/042 137/360
6,334,463 B1 * 1/2002 Lee ..... E03C 1/0404 137/360
7,201,404 B1 * 4/2007 Kronmeyer ..... F16L 19/0231 285/327
7,258,322 B1 * 8/2007 Yang ..... E03C 1/0404 137/801
7,686,351 B2 * 3/2010 Molina, III ..... F16J 15/061 285/353

(Continued)

*Primary Examiner* — David E Bochna
(74) *Attorney, Agent, or Firm* — Rosenberg, Klein & Lee

(57) ABSTRACT

An adapter sleeve includes a main body having a through opening formed therethrough, so as to be assembled to a water pipe, the main body having an outer threaded portion formed on an outer surface thereof, the through opening having a first portion and a second portion, a diameter of the first portion of the through opening larger than that of the second portion, a step portion defined by the connecting site between the first portion and the second portion, the first portion having an inner threaded portion formed on an inner surface thereof, the second portion having a ring groove formed around an inner surface thereof, a ring member positioned on the ring groove.

5 Claims, 16 Drawing Sheets

(56) References Cited

U.S. PATENT DOCUMENTS 7,793,365 B2 * 9/2010 Miura ..... E03C 1/0403 137/360
8,214,941 B2 * 7/2012 Furseth ..... E03C 1/042 4/675
8,566,975 B1 * 10/2013 Lin ..... E03C 1/0404 4/678
2004/0261853 A1 * 12/2004 Jennings ..... E03C 1/042 137/360
2008/0099089 A1 * 5/2008 Yang ..... E03C 1/0401 137/625.48
2009/0205128 A1 * 8/2009 Jones ..... E03C 1/0404 4/678
2012/0204987 A1 * 8/2012 Yeh ..... E03C 1/0403 137/801
2012/0211108 A1 * 8/2012 Yeh ..... F16K 51/00 137/801
2012/0266989 A1 * 10/2012 Huang ..... E03C 1/042 137/798
2012/0266990 A1 * 10/2012 Huang ..... E03C 1/042 137/801
2012/0266991 A1 * 10/2012 Huang ..... E03C 1/042 137/801
2012/0266993 A1 * 10/2012 Huang ..... E03C 1/0403 137/874
2012/0280068 A1 * 11/2012 Huang ..... E03C 1/0404 239/586
2014/0338767 A1 * 11/2014 Chen ..... E03C 1/0404 137/801
2015/0152626 A1 * 6/2015 Huang ..... E03C 1/0404 137/119.05
2015/0167849 A1 * 6/2015 Yang ..... E03C 1/0404 251/319

* cited by examiner

TAP AND AN ADAPTER THEREOF

BACKGROUND OF THE INVENTION

1. Field of the Invention

The present invention relates to a tap, and more particularly to a tap with an adapter.

2. Description of the Prior Art

Usually, a tap is assembled to a wall so as to connect to a water pipe on the wall. However, the water pipes in the area have various types. If the tap is not suitable for the water pipe, the tap would not be able to connect to the water pipe. In order to overcome this issue, an adapter comes to the world.

Referring to FIGS. 13-14, an adapter sleeve 6A is screwed to a drain tube 51 in a tap set 5A. The adapter sleeve 6A has an opening 61 formed thereon. A tie ring 52 is mounted around the drain tube 51. A screw 53 is screwed through the tie ring 52 and the drain tube 51 into the opening 61. A water pipe 7 without threaded structure is inserted into the adapter sleeve 6A, and the screw 53 abuts against the water pipe 7. Referring to FIGS. 15-16, here is provided an adapter sleeve 6B. The adapter sleeve 6B is screwed to a drain tube 54 in a tap set 5B. A water pipe 7 without threaded structure is inserted into the adapter sleeve 6B.

However, the conventional adapter sleeve still has some disadvantages as follows.

The size of the water pipe 7 without threaded structure is ½ inch. The size of another water pipe with threaded structure is ⅝ or ¾ inch. The conventional adapter sleeve is suitable for only one certain type of the water pipe; in other words, if one conventional adapter sleeve is not suitable for the type of one water pipe, the user must retake another conventional adapter sleeve which might be suitable. Therefore, it's very inconvenient for the user.

The present invention is, therefore, arisen to obviate or at least mitigate the above mentioned disadvantages.

SUMMARY OF THE INVENTION

An object of the present invention is to provide an improved adapter sleeve which is suitable for water pipes with different types, so that it's convenient for a user.

To achieve the above and other objects, an adapter sleeve comprises a main body having a through opening formed therethrough, so as to be assembled to a water pipe, the main body having an outer threaded portion formed on an outer surface thereof, the through opening having a first portion and a second portion, a diameter of the first portion of the through opening larger than that of the second portion, a step portion defined by the connecting site between the first portion and the second portion, the first portion having an inner threaded portion formed on an inner surface thereof, the second portion having a ring groove formed around an inner surface thereof, a ring member positioned on the ring groove. Wherein, the main body has a threaded hole formed on the outer surface thereof, the threaded hole communicating with the through opening, a screw screwed into the threaded hole until the screw abuts against the water pipe, so as to tighten one portion of the water pipe in the main body.

A tap comprises a tap case, a drain tube, a control member and a adapter sleeve, the tap case having an exit at a front end thereof, the drain tube assembled in the tap case, one end of the drain tube connected to the exit, the control member inserted into the tap case and being movable, so as to control the on-off state of the drain tube, the adapter sleeve set at the other end of the drain tube, the adapter sleeve assembled to the water pipe extended from the wall; wherein, the adapter sleeve comprising a main body having a through opening formed therethrough, so as to be assembled to a water pipe, the main body having an outer threaded portion formed on an outer surface thereof, the through opening having a first portion and a second portion, a diameter of the first portion of the through opening larger than that of the second portion, a step portion defined by the connecting site between the first portion and the second portion, the first portion having inner threaded portion formed on an inner surface thereof, the second portion having a ring groove formed around an inner surface thereof, a ring member positioned on the ring groove. Wherein, the main body has a threaded hole formed on the outer surface thereof, the threaded hole communicating with the through opening, a screw screwed into the threaded hole until the screw abuts against the water pipe, so as to tighten one portion of the water pipe in the main body; a washer is assembled between the drain tube and the adapter sleeve.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
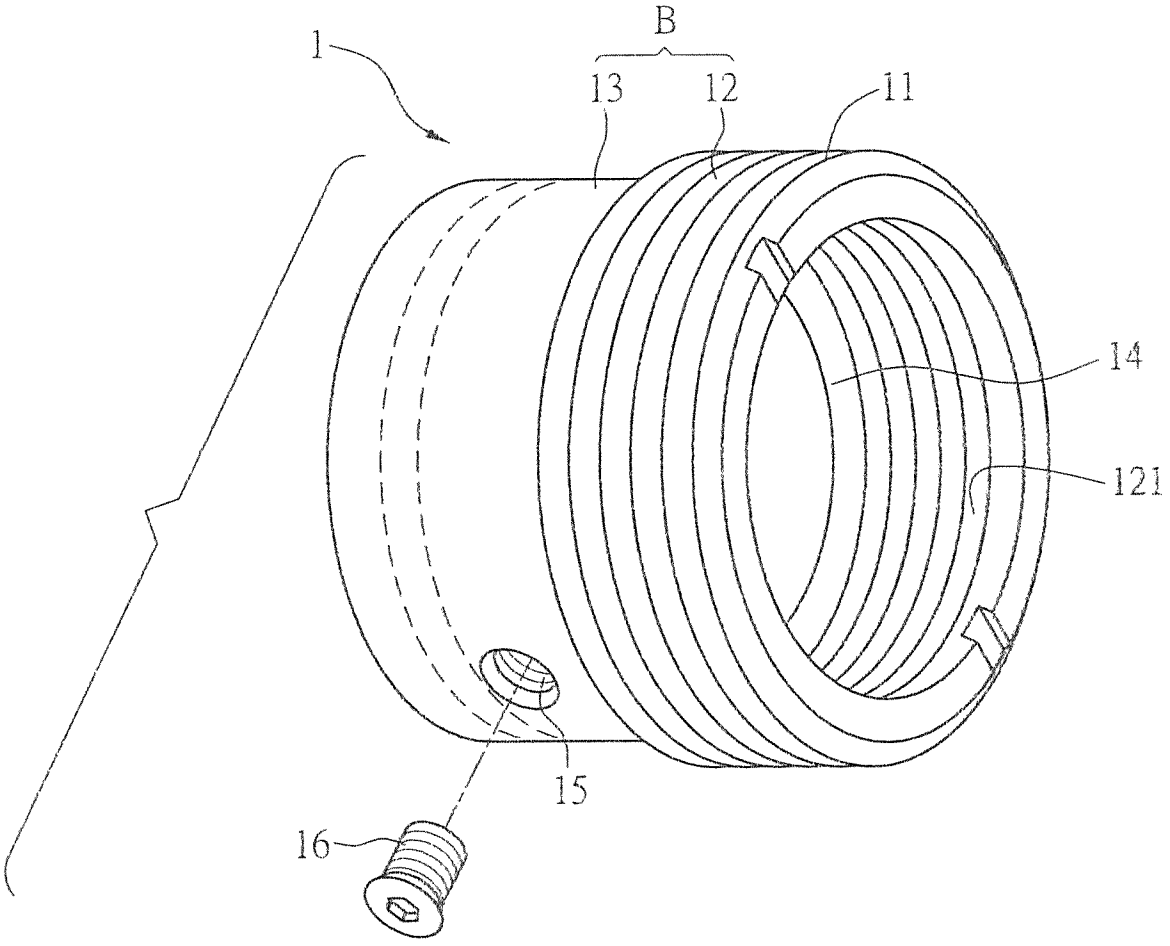
FIG. 1 is a perspective view of one embodiment in accordance with an adapter of the present invention.
Figure 2:
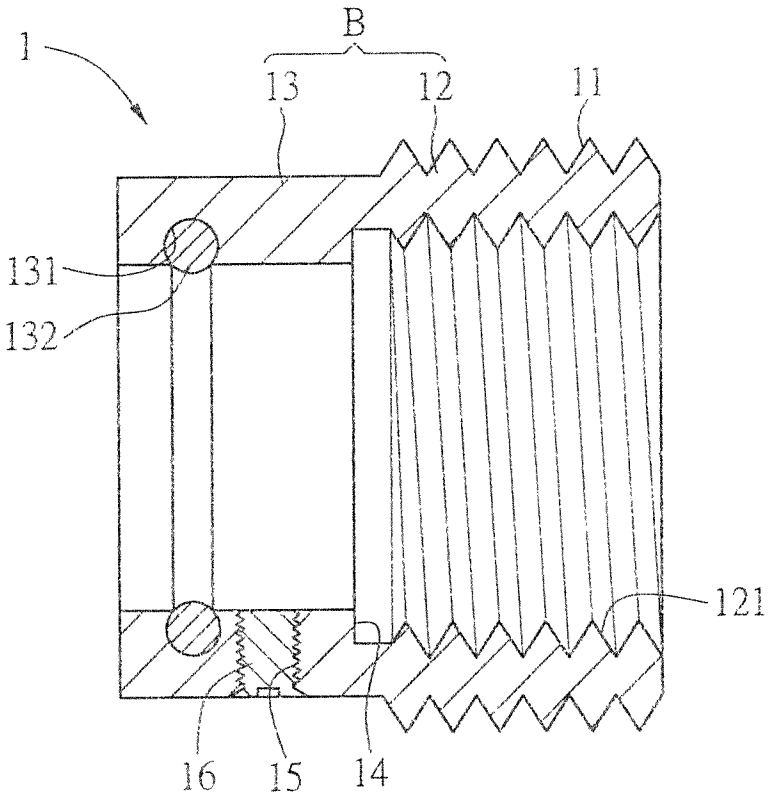
FIG. 2 is a cross-sectional view of the embodiment in accordance with the adapter of the present invention.

Referring to FIGS. 1-2, one embodiment in accordance with an adapter of the present invention is described as follows. An adapter sleeve 1 comprises a main body B. The main body B has a through opening formed therethrough, so as to be assembled to a water pipe. The main body B has an outer threaded portion 11 formed on an outer surface thereof. The main body B has a first fit portion 12 and a second fit portion 13 which are connected to each other. The through opening is defined by the first fit portion 12 and the second fit portion 13. A first portion of the through opening corresponds to the first fit portion 12 and a second portion of the through opening corresponds to the second fit portion 13. A diameter of the first portion is larger than that of the second portion. In this preferred embodiment, the diameter of the first portion is ⅝ inch, and the diameter of the second portion is ½ inch. A step portion 14 is defined by the connecting site between the first portion and the second portion. The first fit portion 12 has an inner threaded portion 121 formed on an inner surface thereof. The second fit portion 13 has a ring groove 131 formed around the second portion of the through opening on an inner surface thereof. A ring member 132 is positioned on the ring groove 131.

The adapter sleeve 1 is configured to be assembled to the water pipe extended from a wall. The adapter sleeve 1 is fixed to a tap set, via the outer threaded portion 11 on the outer surface of the main body B. Then, the adapter sleeve 1 is assembled to the water pipe on a wall, via the through opening of the main body B. Therefore, the water from the water pipe could flow out from the tap set. The adapter sleeve 1 could be assembled to the water pipe at a suitable portion thereof, according to the type of the water pipe. Clearly, if the diameter of the water pipe is ⅝ inch, the adapter sleeve 1 should be assembled to the water pipe at the first fit portion 12 of the main body B; if the diameter of the water pipe is ½ inch, the adapter sleeve 1 should be assembled to the water pipe at the second fit portion 13 of the main body B. Therefore, the adapter sleeve 1 is suitable for water pipes with different types, via the different fit portions, so that it's convenient for a user.

In addition, in this embodiment, the main body B has a threaded hole 15 formed on the outer surface thereof. The threaded hole 15 communicates with the through opening. Clearly, the threaded hole 15 is formed on the second fit portion 13 of the main body B. A screw 16 is screwed into the threaded hole 15 until the screw 16 abuts against the water pipe, so as to tighten one portion of the water pipe in the main body B.

Figure 3:
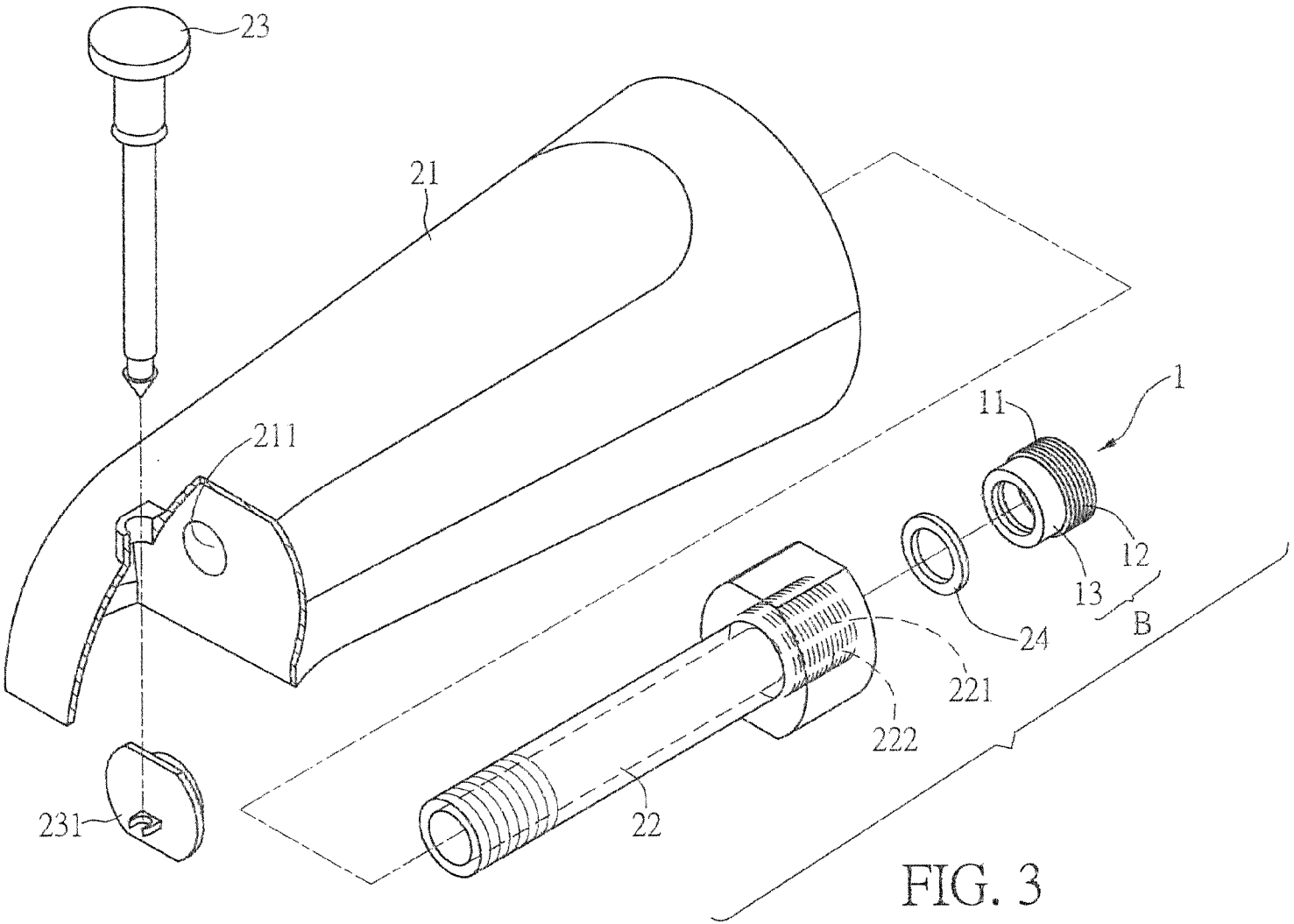
FIG. 3 is an explored view of a first embodiment in accordance with a tap of the present invention.
Figure 4:
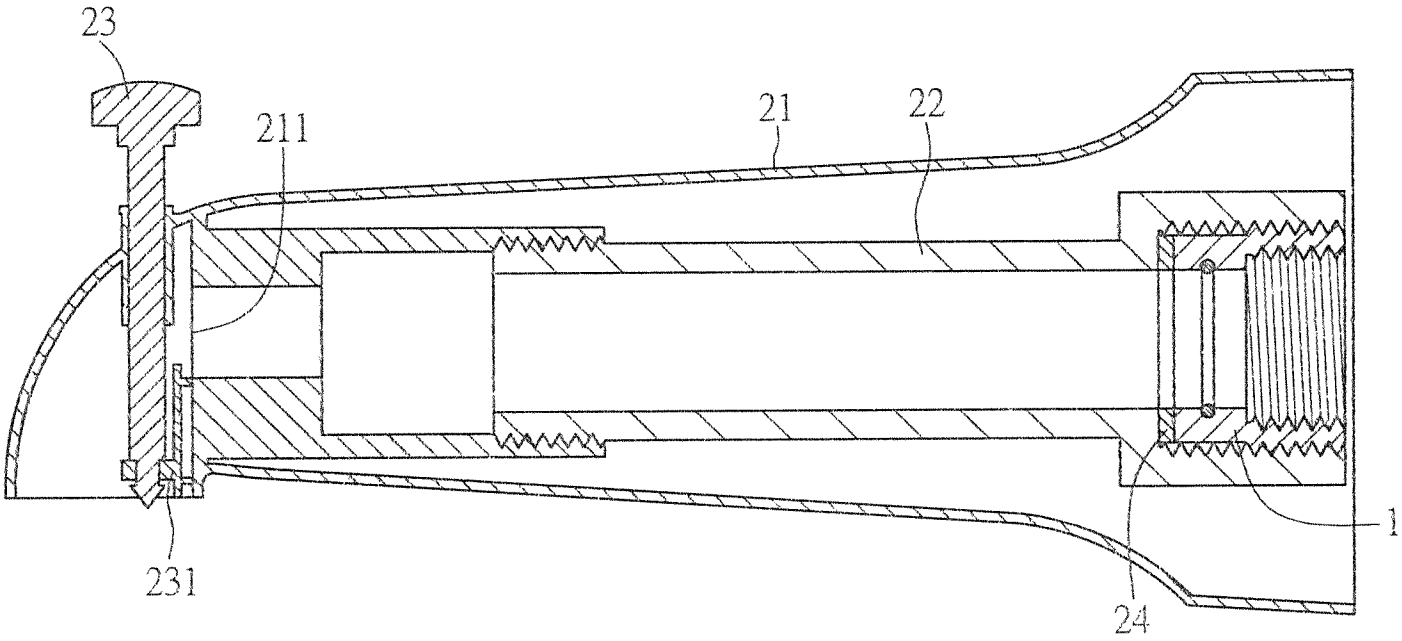
FIG. 4 is a cross-sectional view of the first embodiment in accordance with the tap of the present invention.

Referring to FIGS. 3-4, a first embodiment in accordance with a tap of the present invention is described as follows. The tap has a tap case 21, a drain tube 22, a control member 23 and the adapter sleeve 1. The tap case 21 has an exit 211 at a front end thereof. A diameter of the drain tube 22 is ¾ inch. The drain tube 22 is assembled in the tap case 21. One end of the drain tube 22 is connected to the exit 211. The adapter sleeve 1 is set at the other end of the drain tube 22. The adapter sleeve 1 is assembled to the water pipe extended from the wall (not shown). As a result, the water from the water pipe could flow into the drain tube 22, and the control member 23 could control the on-off state of the drain tube 22 so as to allow the water to flow out or not. Specially, the control member 23 is illustrated as a control lever which is vertically extended. A plug member 231 is assembled at a bottom end of the control member 23. The control member 23 is inserted from a top side of the tap case 21 into the tap case 21. Then, the plug member 31 is moved to the drain tube 22 so as to prohibit the water from flowing out. The control member 23 is vertically movable, so as to control the on-off state of the drain tube 22.

The drain tube 22 has a receiving room 221 at on end thereof. An inside threaded portion 222 is formed on an inner wall of the receiving room 221. The main body B is screwed into the receiving room 221, so that the adapter sleeve 1 is fixed in the receiving room 221 via the outer threaded portion 11 of the main body B and the inside threaded portion 222 of the receiving room 221. Clearly, a washer 24 is assembled at a bottom portion of the receiving room 221, and abuts against the adapter sleeve 1 fixed in the receiving room 221.

Figure 5:
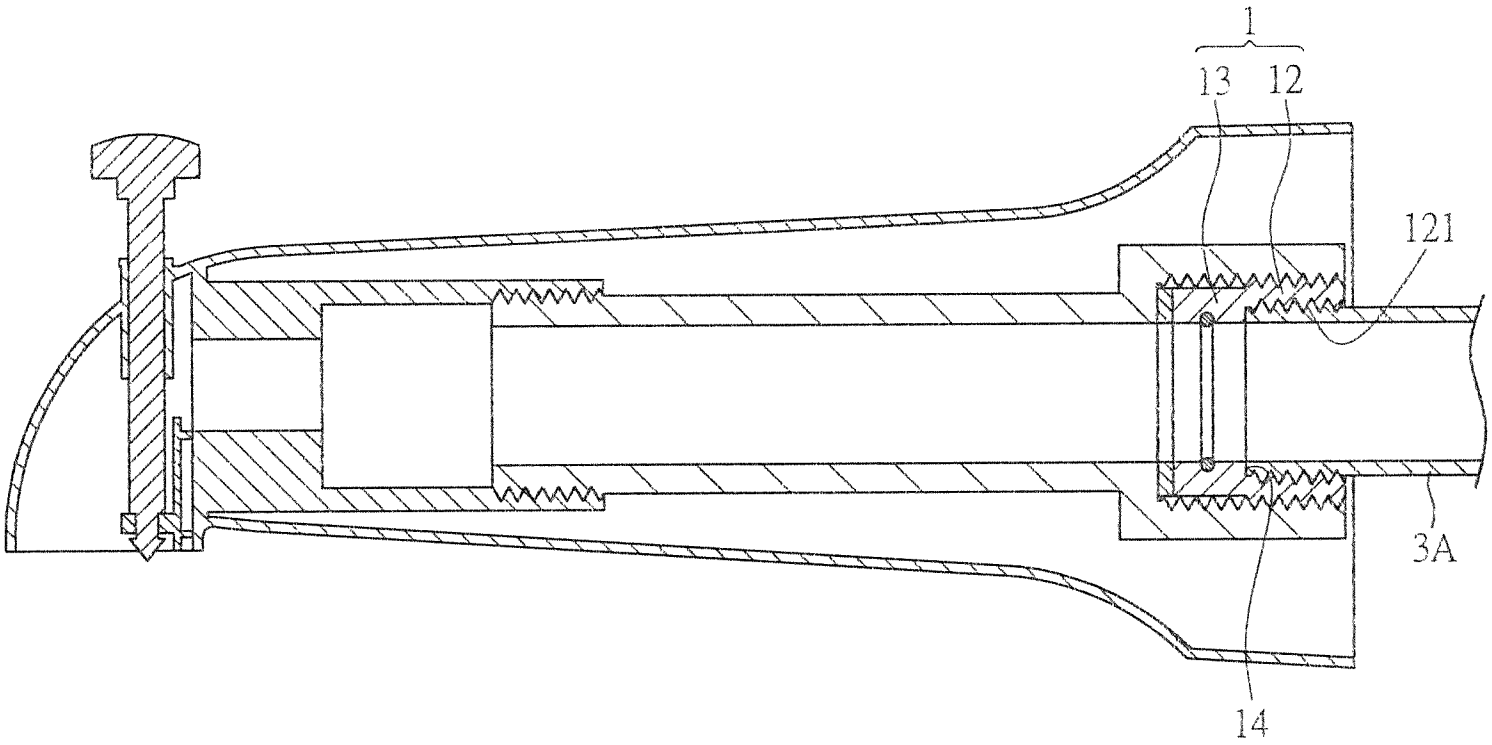
FIGS. 5-7 are cross-sectional views for showing operation states of the first embodiment in accordance with the tap of the present invention.
Figure 6:
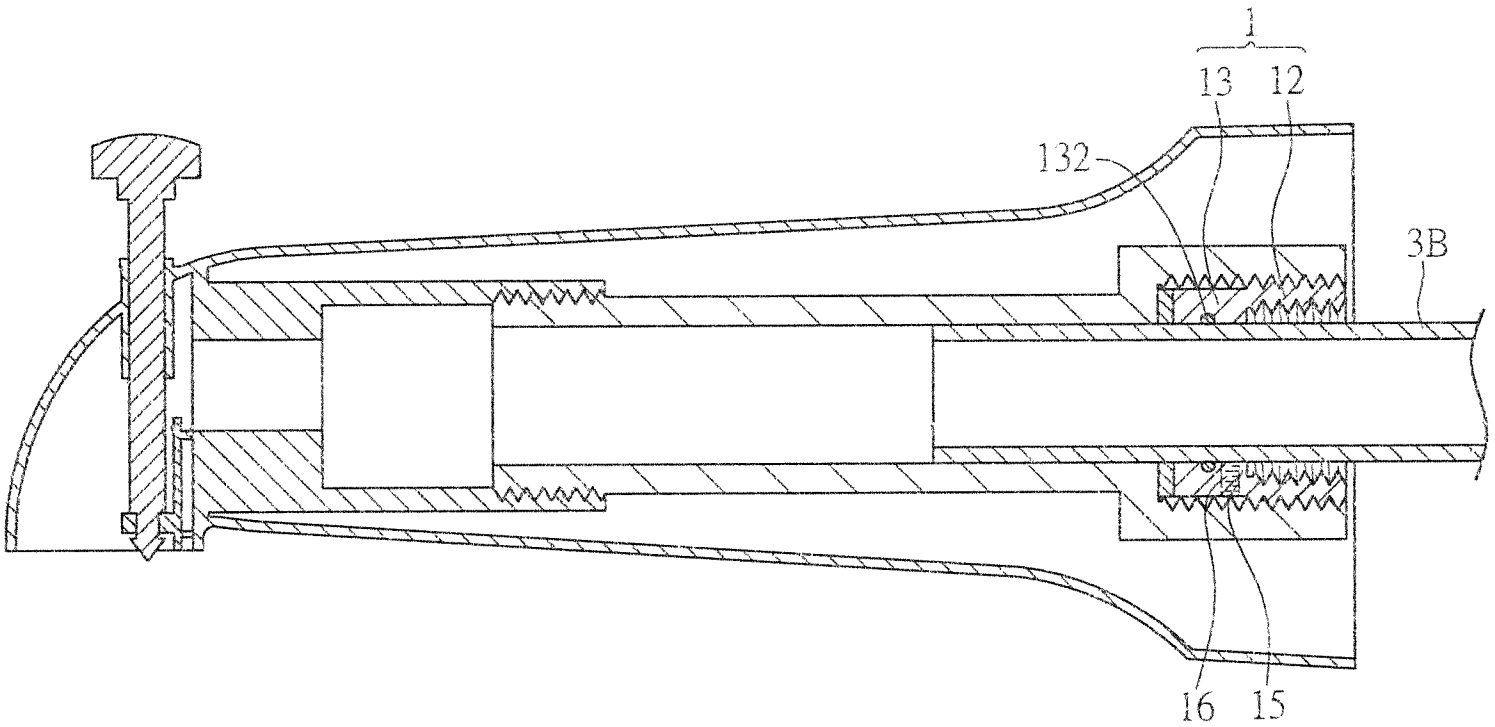

Referring to FIG. 5, a water pipe 3A has a diameter with ⅝ inch. The water pipe 3A is assembled at the first fit portion 12 of the main body B. Clearly, the water pipe 3A abuts against the step portion 14, and is engaged with the inner threaded portion 121 of the first fit portion 12. Referring to FIG. 6, a water pipe 3B has a diameter with ½ inch. The water pipe 3B is assembled at the second lit portion 13 of the main body B. Clearly, the water pipe 3B passes through the first fit portion 12 and extended into the second fit portion 13. The ring member 132 of the second fit portion 13 encloses the water pipe 3B and abuts against the water pipe 3B, so as to have the water pipe 3B tightly assembled. Therefore, the adapter sleeve 1 is suitable for water pipes with different types, via the different fit portions, so that it's convenient for the user.

In addition, the main body B has the threaded hole 15 formed on the outer surface thereof. The threaded hole 15 communicates with the through opening. Clearly, the threaded hole 15 is formed on the second tit portion 13 of the main body B. The screw 16 is screwed into the threaded hole 15 until the screw 16 abuts against the water pipe 3B, so as to tighten one portion of the water pipe 3B in the main body B.

Figure 7:
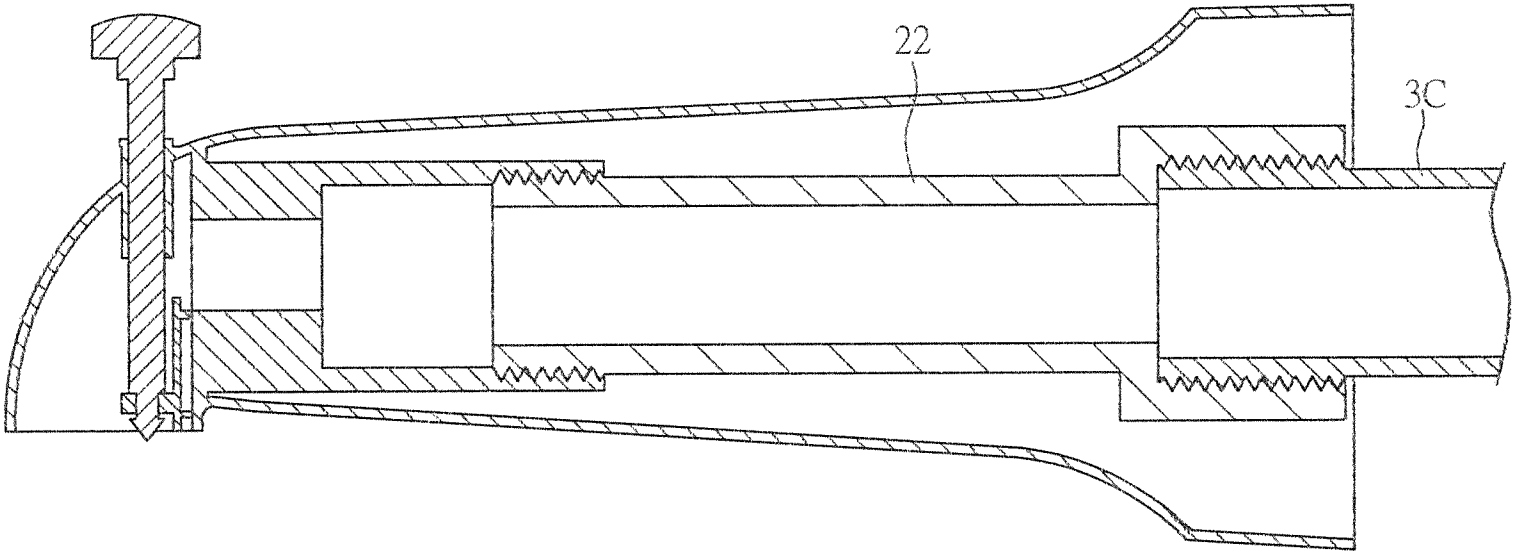

Furthermore, referring to FIG. 7, a water pipe 3C has a diameter with ¾ inch. The adapter sleeve 1 should be removed from the drain tube 22, because the diameter of the drain tube 22 is precisely ¾ inch. Therefore, the water pipe 3C is directly assembled at the drain tube 22, so that it's convenient for the user.

Figure 8:
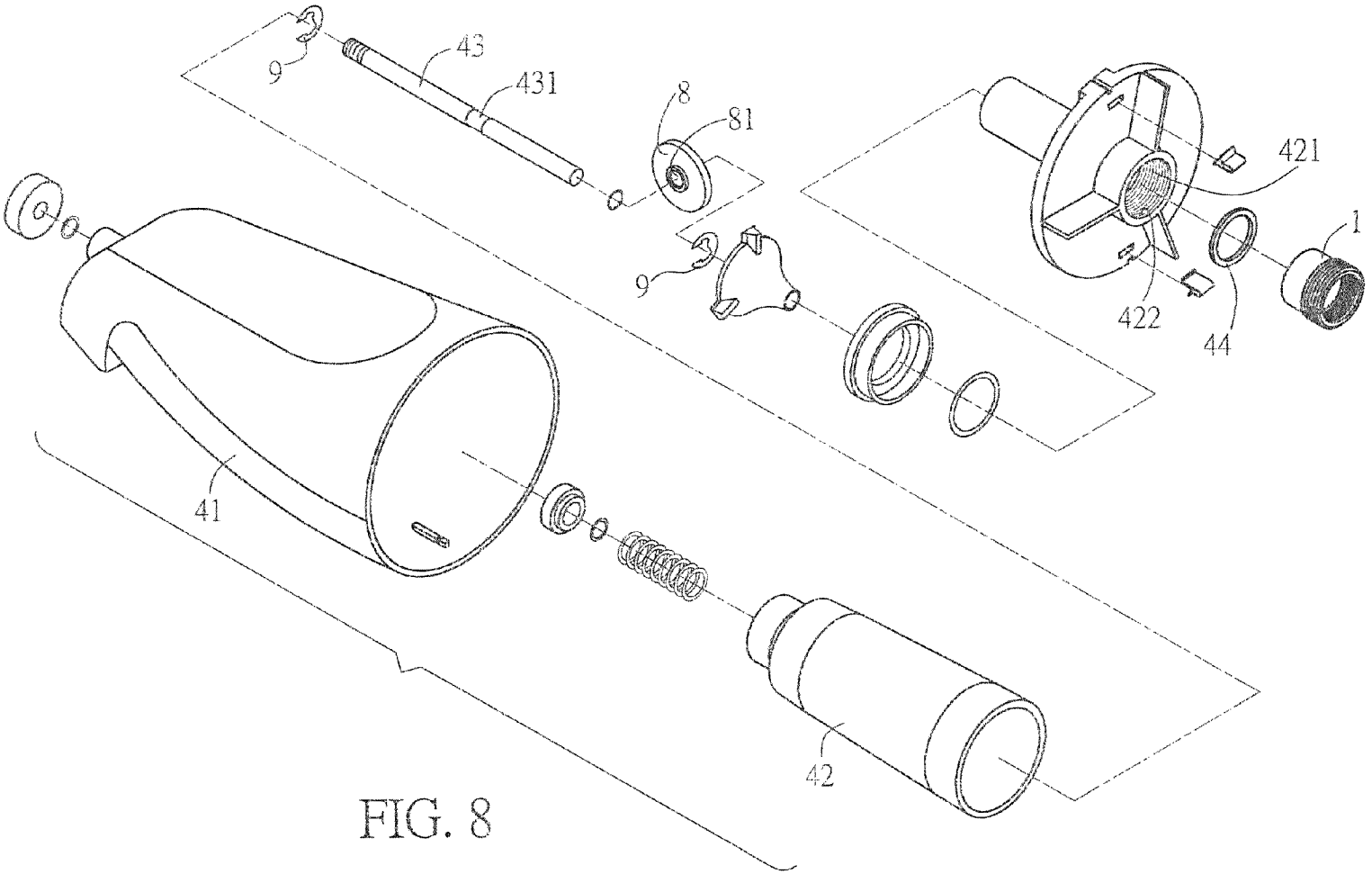
FIG. 8 is an explored view of a second embodiment in accordance with a tap of the present invention.
Figure 9:
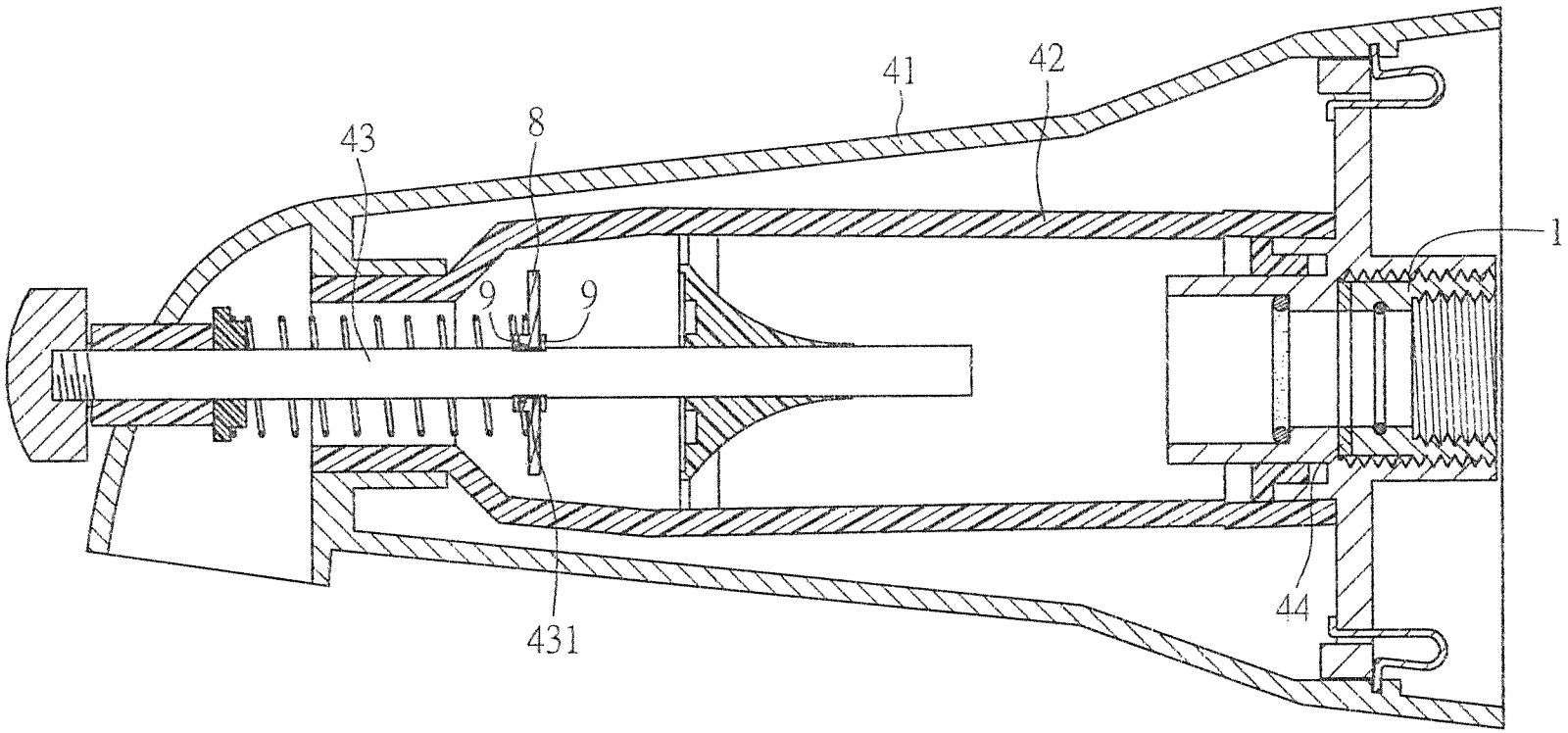
FIG. 9 is a cross-sectional view of the second embodiment in accordance with the tap of the present invention.

Referring to FIGS. 8-9, a second embodiment in accordance with a tap of the present invention is described as follows. The tap has a tap case 41, a drain tube 42, a control member 43 and the adapter sleeve 1. The tap case 41 has an exit at a front end thereof (not shown). A diameter of the drain tube 42 is ¾ inch. The drain tube 42 is assembled in the tap case 41. One end of the drain tube 42 is connected to the exit. The adapter sleeve 1 is set at the other end of the drain tube 42. The adapter sleeve 1 is assembled to the water pipe extended from the wall shown). As a result, the water from the water pipe could flow into the drain tube 42, and the control member 43 could control the on-off state of the drain tube 42 so as to allow the water to flow out or not. Specially, the control member 43 is illustrated as a control lever which is horizontally extended. The control member 43 is extended from the drain tube 42 to a front end of the tap case 41 exposedly. The control member 43 is horizontally movable, so as to control the on-off state of the drain tube 42.

The drain tube 42 has a receiving room 421 at on end thereof. An inside threaded portion 422 is formed on an inner wall of the receiving room 421. The main body B is screwed into the receiving room 421, so that the adapter sleeve 1 is fixed in the receiving room 421 via the outer threaded portion 11 of the main body B and the inside threaded portion 422 of the receiving room 421. Clearly, a washer 44 is assembled at a bottom portion of the receiving room 421, and abuts against the adapter sleeve 1 fixed in the receiving room 421.

Figure 10:
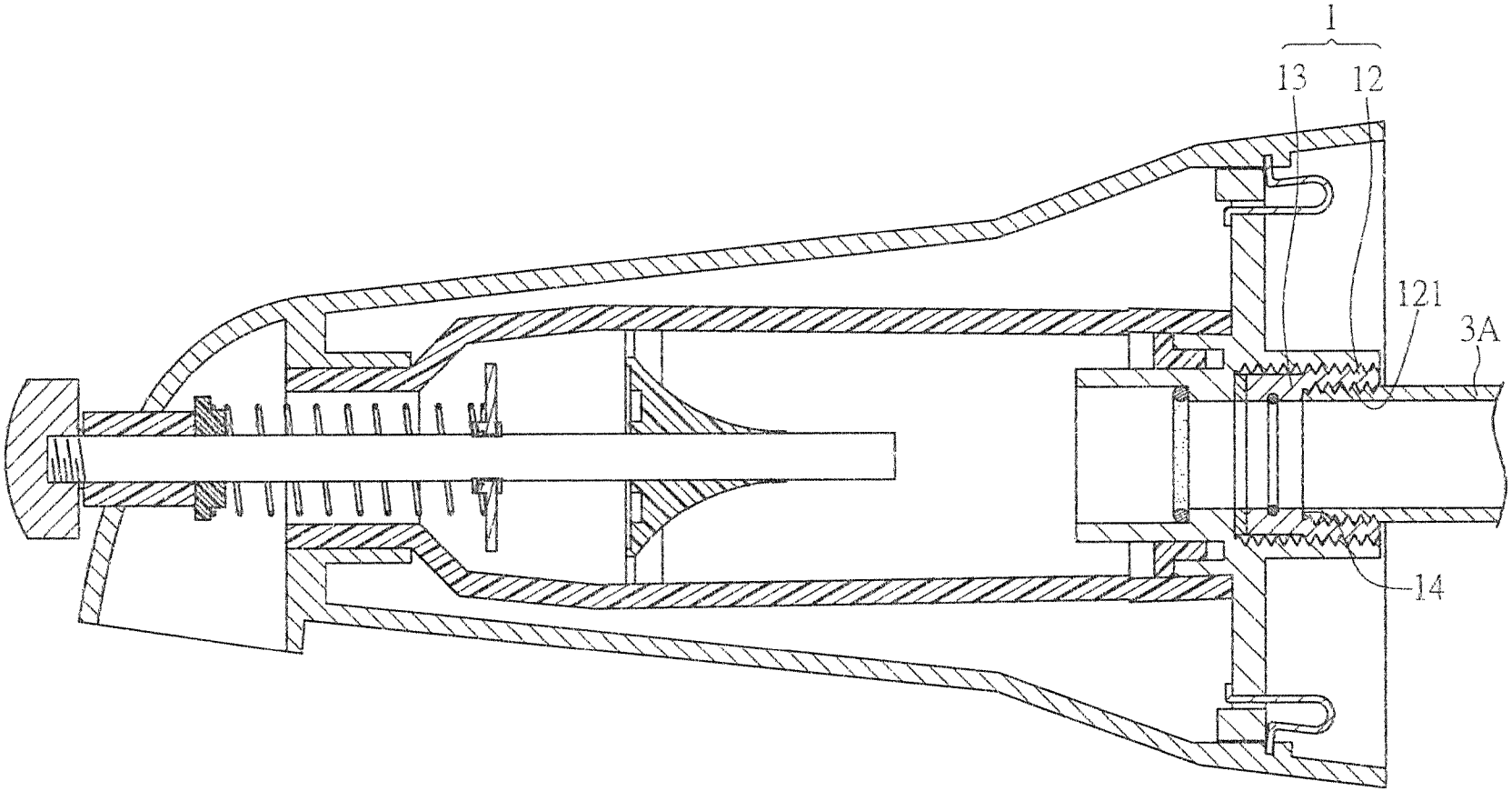
FIGS. 10-12 are cross-sectional views for showing operation states of the second embodiment in accordance with the tap of the present invention.
Figure 11:
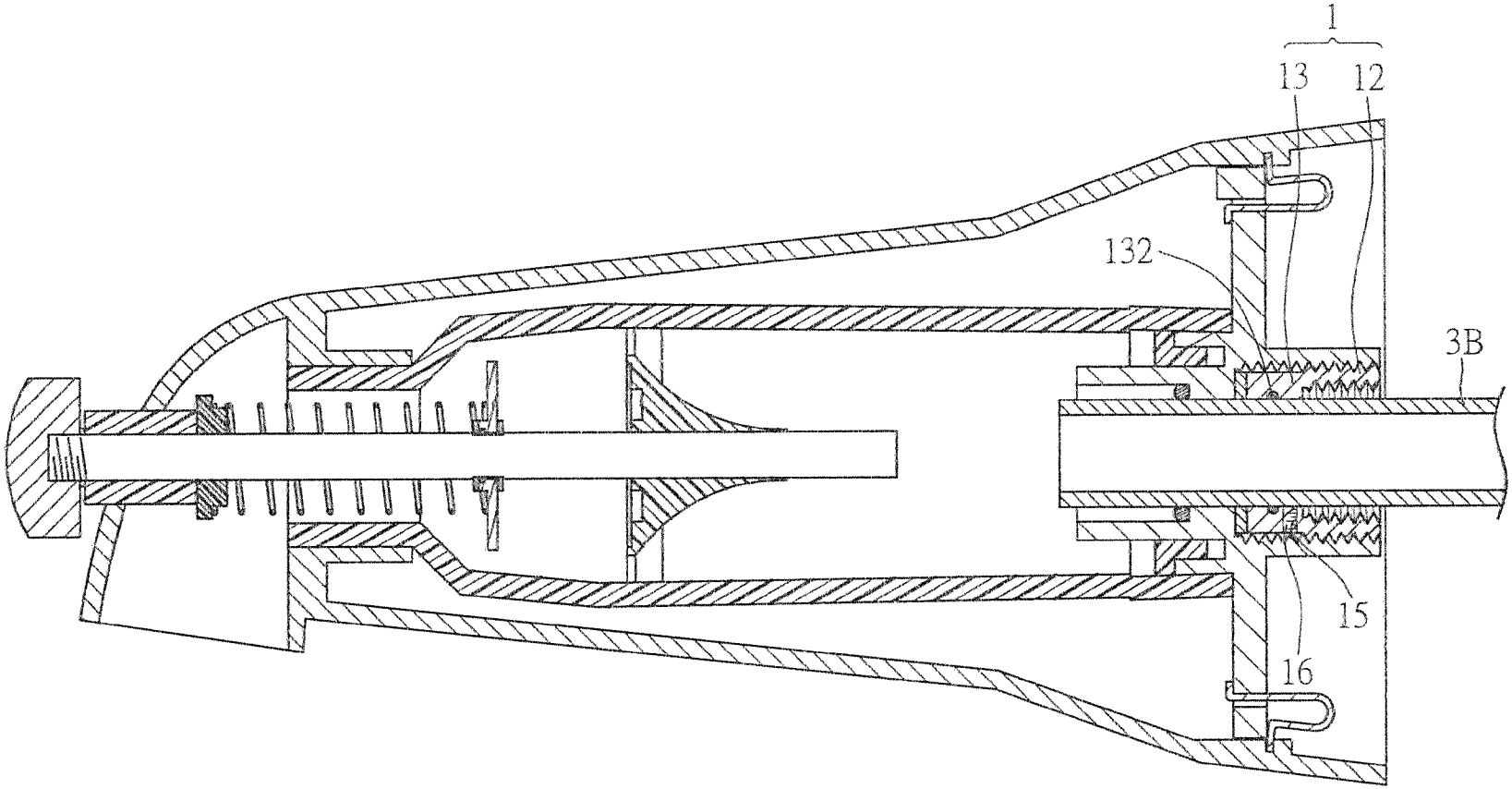

Referring to FIG. 10, a water pipe 3A has a diameter with ⅝ inch. The water pipe 3A is assembled at the first fit portion 12 of the main body B. Clearly, the water pipe 3A abuts against the step portion 14, and is engaged with the inner threaded portion 121 of the first fit portion 12. Referring to FIG. 11, a water pipe 3B has a diameter with ½ inch. The water pipe 3B is assembled at the second fit portion 13 of the main body B. Clearly, the water pipe 3B passes through the first fit portion 12 and extended into the second fit portion 13. The ring member 132 of the second fit portion 13 encloses the water pipe 3B and abuts against the water pipe 3B, so as to have the water pipe 3B tightly assembled. Therefore, the adapter sleeve 1 is suitable for water pipes with different types, via the different fit portions, so that it's convenient for the user.

In addition, the main body B has the threaded hole 15 formed on the outer surface thereof. The threaded hole 15 communicates with the through opening. Clearly, the threaded hole 15 is formed on the second fit portion 13 of the main body B. The screw 16 is screwed into the threaded hole 15 until the screw 16 abuts against the water pipe 3B, so as to tighten one portion of the water pipe 3B in the main body B.

Figure 12:
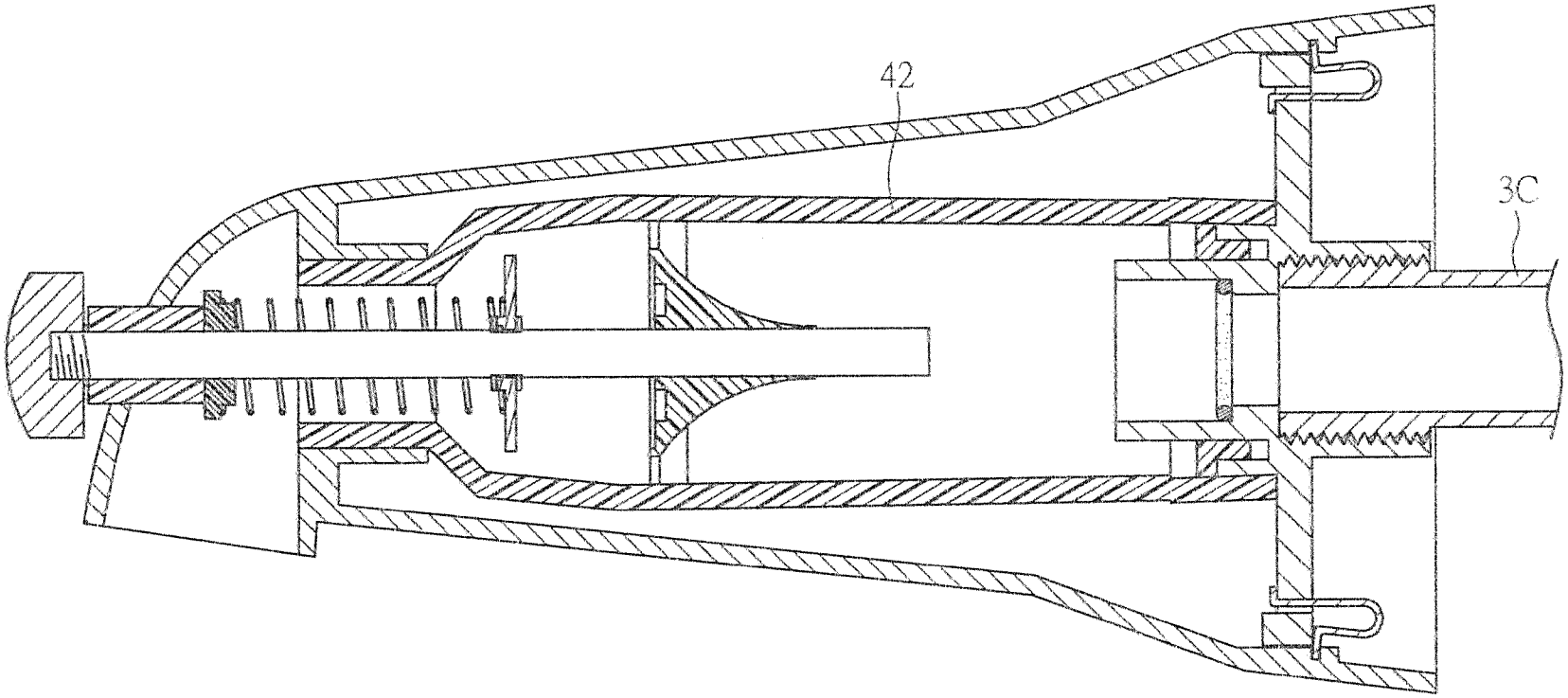
Figure 13:
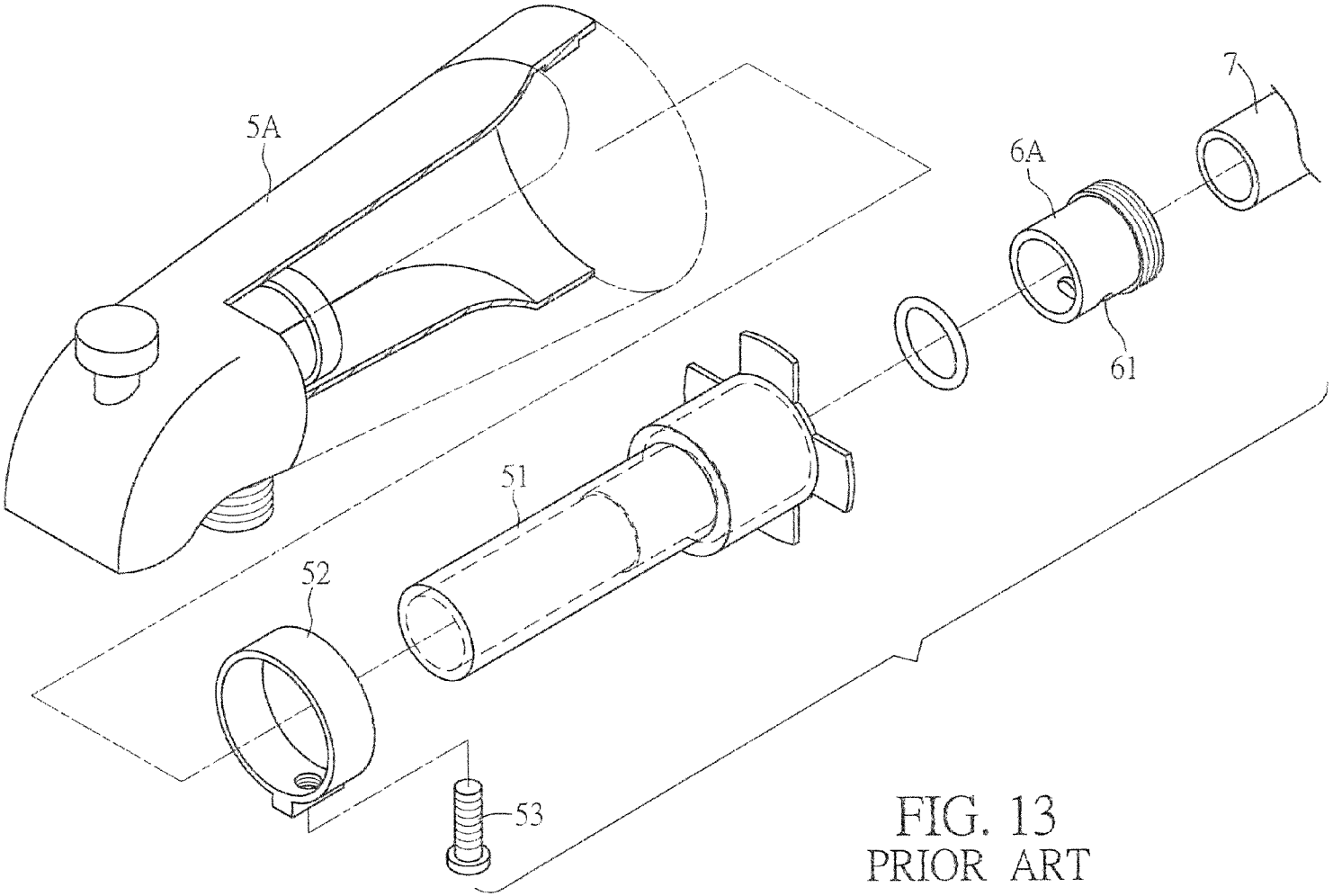
FIG. 13 PRIOR ART
FIG. 13 is an explored view of a conventional tap.
Figure 14:
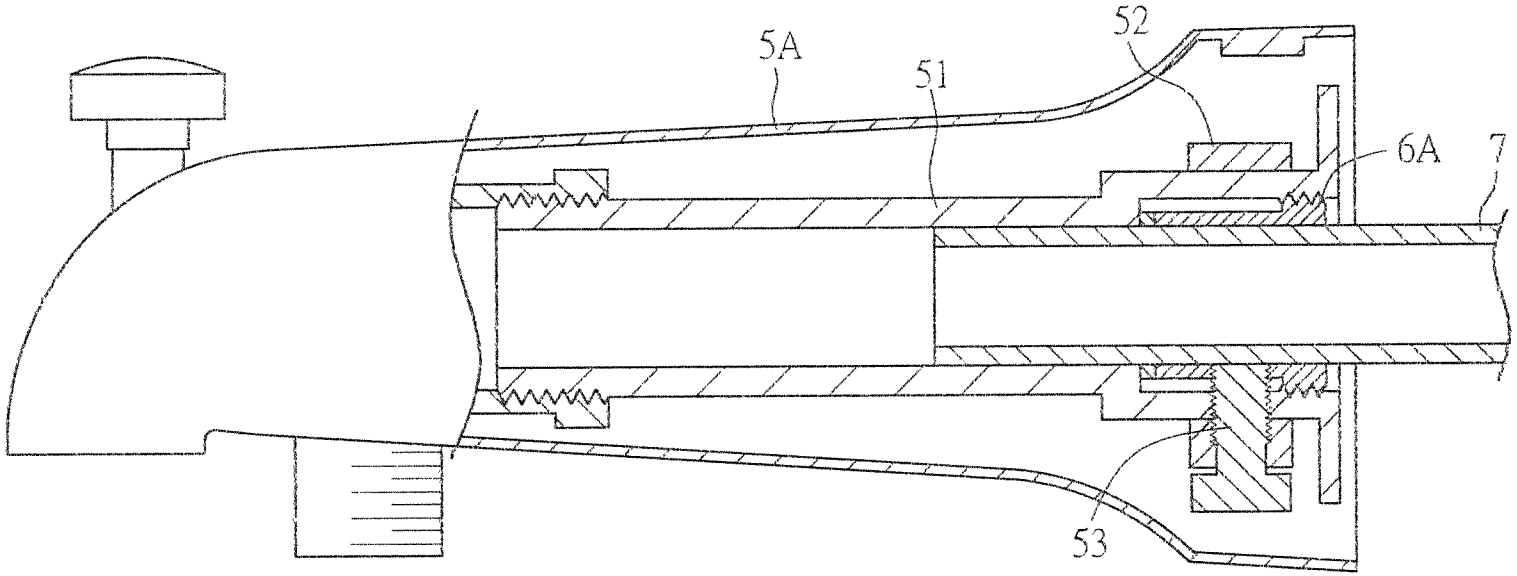
FIG. 14 PRIOR ART
FIG. 14 is a cross-sectional view of the conventional tap.
Figure 15:
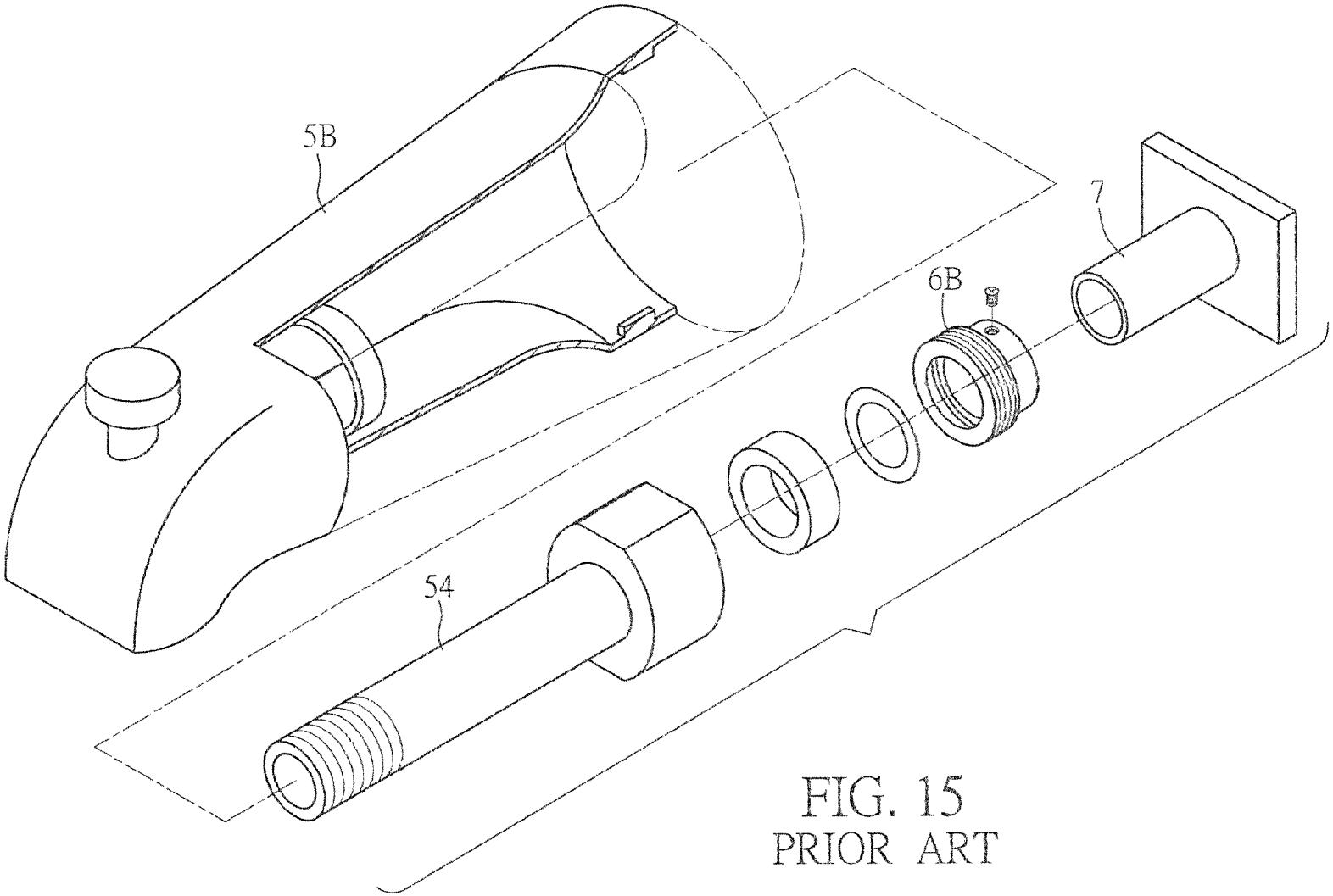
FIG. 15 PRIOR ART
FIG. 15 is an explored view of another conventional tap.
Figure 16:
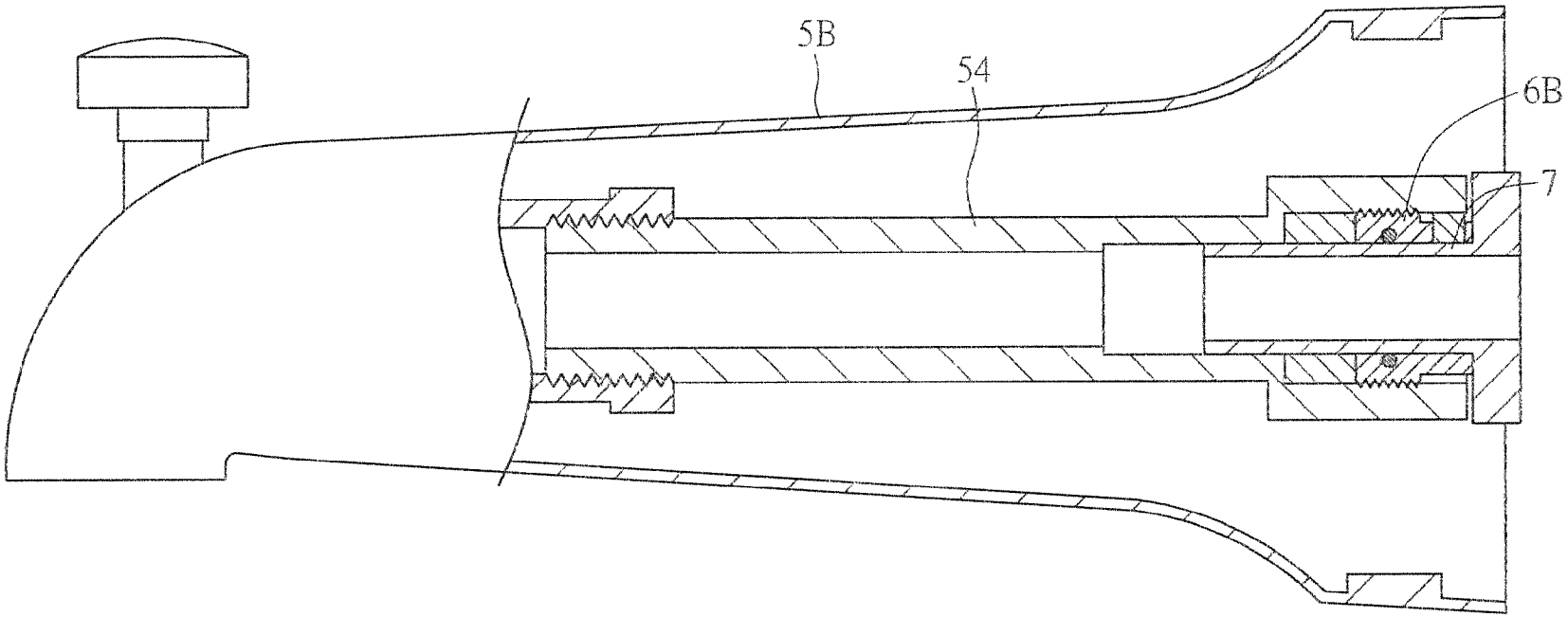
FIG. 16 PRIOR ART
FIG. 16 is a cross-sectional view of the conventional tap.

Furthermore, referring to FIG. 12, a water pipe 3C has a diameter with ¾ inch. The adapter sleeve 1 should be removed from the drain tube 42, because the diameter of the drain tube 42 is precisely ¾ inch. Therefore, the water pipe 3C is directly assembled at the drain tube 42, so that ifs convenient for the user.

Referring to FIGS. 8-9, a plug member 8 is assembled on the control member 43. The plug member 8 is moved by the motion of the control member 43, so as to prohibit the water from flowing out from the drain tube 42. The control member 43 is horizontally movable, so as to control the on-off state of the drain tube 42.

Clearly, the plug member 8 is illustrated as a rigid round plate. The plug member 8 has a through hole 81 formed a center thereof. The diameter of the plug member 8 is slightly larger than that of the cross-section of the control member 43. The plug member 8 is mounted around the control member 43 via the through hole 81 thereof. Specially, the control member 43 has a circle groove 431 formed around a peripheral surface thereof. The plug member 8 is mounted around the control member 43 on the circle groove 431, via the through hole 81 thereof. Two limit members 9 are respectively set on the circle groove 431 at two sides of the plug member 8, so as to limit the plug member 8 to the two limit members 9. Specially, at least one of the two limit members 9 is E-shaped. In this embodiment, both the two limit members 9 are E-shaped. The two limit members 9 are both positioned on the circle groove 431. A distance between the two limit members 9 is slightly larger than the thickness of the plug member 8. Because there are buffers between the through hole 81 and the control member 43, and between the two limit embers 9 and the plug member 8, the plug member 8 could be swung relative to the control member 43.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An adapter sleeve comprising:

a main body having a through opening formed therethrough to be assembled to a water pipe, the main body having a first fit portion and a second fit portion extending coaxially therefrom;

the first fit portion having an outer threaded portion formed contiguously about an outer surface thereof, and an inner surface forming an inner threaded portion about a first portion of the through opening;

the second fit portion having a substantially smooth outer surface and a substantially smooth inner surface about a second portion of the through opening;

the first portion of the through opening being larger in diameter than the second portion, a step portion defined between the first portion and the second portion, the second fit portion having a ring groove formed in the inner surface thereof, a ring member positioned on the ring groove.

2. The adapter sleeve as claimed in claim 1, wherein the main body has a threaded hole formed on an outer surface thereof, the threaded hole communicating with the through opening, a screw screwed into the threaded hole until the screw abuts against the water pipe, so as to tighten one portion of the water pipe in the main body.

3. A tap comprising:

a tap case, a drain tube, a control member, and an adapter sleeve, the tap case having an exit at a front end thereof, the drain tube assembled in the tap case, a first end of the drain tube connected to the exit, the control member inserted into the tap case and being movable to control an on-off state of the drain tube, the adapter sleeve set at a second end of the drain tube, the adapter sleeve assembled to a water pipe extending from a wall;

wherein, the adapter sleeve includes:

a main body having a through opening formed therethrough to be assembled to the water pipe, the main body having a first fit portion and a second fit portion extending coaxially therefrom;

the first fit portion having an outer threaded portion formed contiguously about an outer surface thereof, and an inner surface forming an inner threaded portion about a first portion of the through opening;

the second fit portion having a substantially smooth outer surface and a substantially smooth inner surface about a second portion of the through opening;

the first portion of the through opening being larger in diameter than the second portion, a step portion defined between the first portion and the second portion, the second fit portion having a ring groove formed in the inner surface thereof, a ring member positioned on the ring groove.

4. The tap as claimed in claim 3, wherein the main body has a threaded hole formed on an outer surface thereof, the threaded hole communicating with the through opening, a screw screwed into the threaded hole until the screw abuts against the water pipe, so as to tighten one portion of the water pipe in the main body.

5. The tap as claimed in claim 3, wherein a washer is assembled between the drain tube and the adapter sleeve.

* * * * *